US008347679B2

(12) United States Patent
Liu

(10) Patent No.: US 8,347,679 B2
(45) Date of Patent: Jan. 8, 2013

(54) UNLOCKING DEVICE FOR CONCEALING KEYHOLE OF LOCK

(76) Inventor: Shih-Te Liu, Kaohsiung (TW)

( * ) Notice: Subject to any disclaimer, the term of this patent is extended or adjusted under 35 U.S.C. 154(b) by 584 days.

(21) Appl. No.: 12/566,110

(22) Filed: Sep. 24, 2009

(65) Prior Publication Data

US 2010/0077815 A1 Apr. 1, 2010

(30) Foreign Application Priority Data

Oct. 1, 2008 (TW) ..... 97217617 U

(51) Int. Cl.
*E05B 19/00* (2006.01)
*E05B 15/08* (2006.01)
*E05B 17/14* (2006.01)

(52) U.S. Cl. ..... 70/395; 70/408; 70/423; 70/427; 70/454; 70/455

(58) Field of Classification Search ..... 70/395, 70/408, 423–428, 453–455, DIG. 38
See application file for complete search history.

(56) References Cited

U.S. PATENT DOCUMENTS 249,124 A * 11/1881 Voos ..... 70/428
3,630,053 A * 12/1971 Krakauer ..... 70/51
3,714,804 A * 2/1973 French ..... 70/419
3,765,199 A * 10/1973 Wiczer ..... 70/423
3,834,198 A * 9/1974 Wiczer ..... 70/208
5,077,996 A 1/1992 Lien
5,329,792 A 7/1994 Lee
6,494,064 B1 12/2002 Pena
6,610,947 B2 * 8/2003 Campana et al. ..... 70/395
7,866,194 B2 * 1/2011 Liu ..... 70/395
2007/0157687 A1 * 7/2007 Bull et al. ..... 70/454

FOREIGN PATENT DOCUMENTS

TW M287361 2/2006

* cited by examiner

*Primary Examiner* — Christopher Boswell
(74) *Attorney, Agent, or Firm* — Alan Kamrath; Kamrath IP Lawfirm, PA

(57) ABSTRACT

An unlocking device includes a casing mounted to a side of a lock having a keyhole. A movable body is rotatably received in the casing about an axis. The movable body has a closed end having a through-hole. A key receiving seat is received in the movable body and has a passage. The keyhole is normally blocked by the closed end of the movable body. The movable body can be rotated to align the through-hole with the keyhole and the passage. A manually rotatable linking rod extends through the passage and has an engaging portion for coupling a key received in the passage. The key can be moved into the keyhole by moving the linking rod along the axis and can be rotated for a locking or unlocking operation.

12 Claims, 3 Drawing Sheets

UNLOCKING DEVICE FOR CONCEALING KEYHOLE OF LOCK

BACKGROUND OF THE INVENTION

1. Field of the Invention

The present invention relates to an unlocking device and, more particularly, to an unlocking device that conceals a keyhole of a lock and that can receive and guide a key into the keyhole for locking and unlocking operations.

2. Description of the Related Art

Conventional locks include one or more lock cores that can be rotated for locking or unlocking purposes. The keyholes of the lock cores are generally exposed for receiving keys. However, the locks are liable to be picked through the exposed keyways. Furthermore, the keys could be copied by probing the shapes of the exposed keyways.

Taiwan Utility Model No. M287361 entitled "SAFETY LOCK WITH CONCEALED KEYHOLE" discloses a lock including a body receiving a lock core. An escutcheon is mounted to an outer side of the body and has an opening aligned with a keyhole of the lock core. A magnetic board is mounted inside the escutcheon and includes a through-hole aligned with the opening and having a diameter slightly smaller than the opening. A decorative cover can be retained in the opening by magnetic attraction to conceal the keyhole. However, the decorative cover can be easily removed by a magnet having larger magnetic attraction than the magnetic board or by picking the decorative cover through a gap between the decorative cover and an inner periphery of the opening.

SUMMARY OF THE INVENTION

The primary objective of the present invention is to provide an unlocking device for concealing a keyhole of a lock, preventing the keyhole from being seen and preventing direct access to the keyhole.

Another objective of the present invention is to provide an unlocking device that can guide a key into the keyhole of the lock for locking or unlocking purposes.

A further objective of the present invention is to provide an unlocking device for concealing the keyhole of the lock for providing an enhanced burglarproof effect.

The present invention fulfills the above objectives by providing, in a preferred form, an unlocking device including a casing adapted to be mounted to a side of a lock having a keyhole. The casing includes a compartment extending along an axis and having first and second openings spaced along the axis. The keyhole is located in an extent of the first opening. The casing further includes a lateral opening formed in a peripheral wall of the casing and in communication with the compartment. A movable body is rotatably received in the compartment of the casing about the axis. The movable body includes a closed end and an open end spaced from the closed end along the axis. An insertion space is defined between the closed end and the open end. The insertion space has an insertion hole in the open end. The closed end has a through-hole. The movable body further includes a lateral opening formed in a peripheral wall of the movable body extending between the closed end and the open end along the axis and in communication with the insertion space. A key receiving seat is received in the insertion space of the movable body. The movable body is rotatable relative to the key receiving seat between a first position and a second position. The key receiving seat includes a passage extending from a first side through a second side along the axis and having an enlarged receiving section. The keyhole of the lock is blocked by the closed end of the movable body when the movable body is in the first position. The through-hole of the movable body, the passage of the key receiving seat, and the keyhole of the lock are aligned with and face one another when the movable body is in the second position. A linking rod extends through the passage of the key receiving seat. The linking rod includes first and second ends spaced along the axis. The first end of the linking rod has an engaging portion. The second end of the linking rod is manually rotatable. The engaging portion is used for engaging with a key so that the key and the linking rod are able to jointly move along the axis and jointly rotate about the axis.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
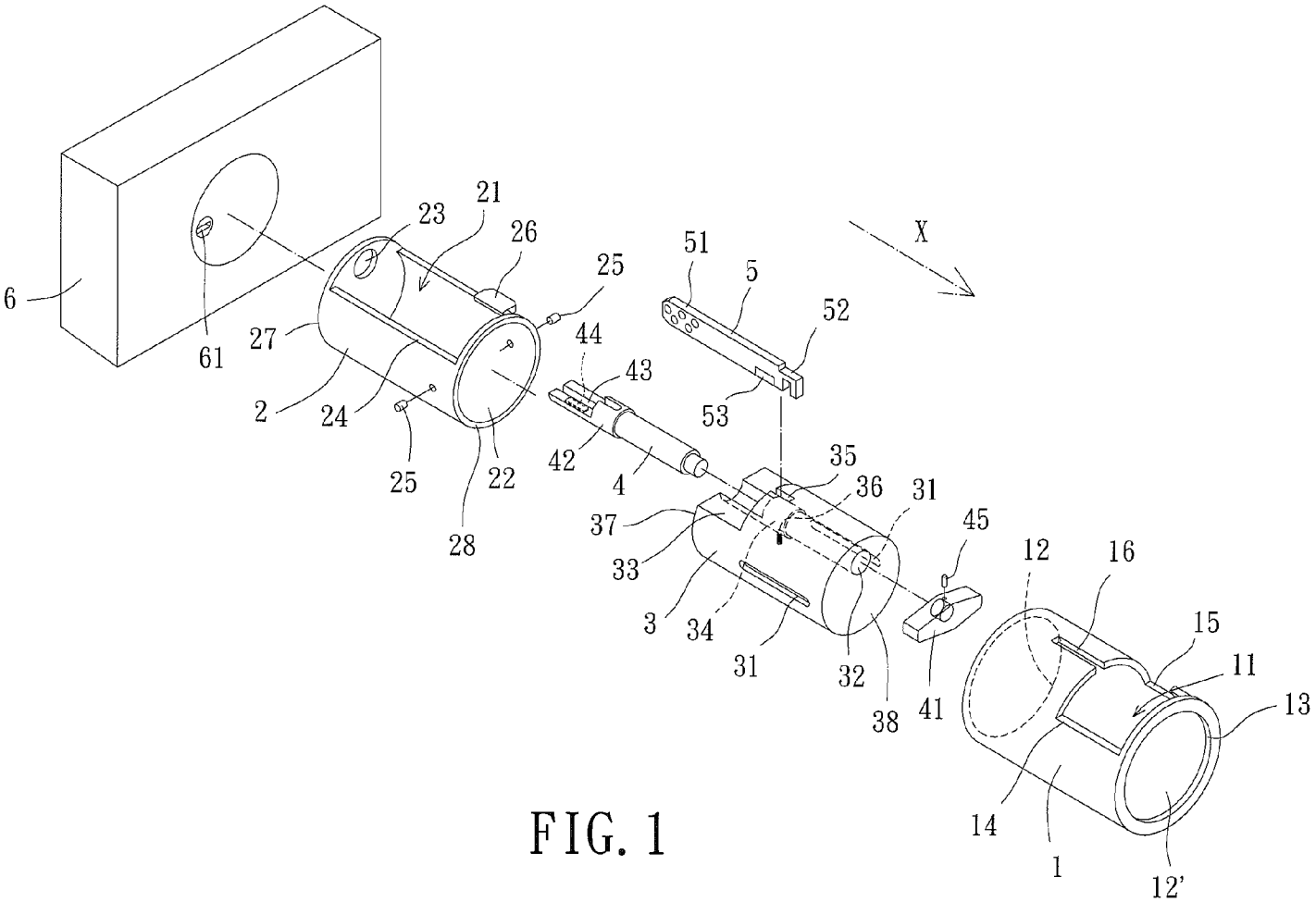
FIG. 1 shows an exploded, perspective view of an unlocking device according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "end", "portion", "section", "radial", "outward", "spacing", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An unlocking device according to the preferred teachings of the present invention is shown in the drawings. According to the preferred form shown, the unlocking device includes a casing 1, a movable body 2, a key receiving seat 3, and a linking rod 4.

According to the preferred form shown in FIG. 1, the casing 1 is adapted to be mounted to a side of a lock 6 having a keyhole 61. The casing 1 includes a compartment 11 extending along an axis X and having first and second openings 12 and 12' spaced along the axis X. The keyhole 61 is located in an extent of the first opening 12. In the most preferred form shown, the casing 1 includes a radial through lateral opening 14 formed in a peripheral wall thereof and in communication with the compartment 11. The lateral opening 14 further communicates with a receiving groove 16 extending from the lateral opening 14 to the first opening 12 along the axis X but spaced from the first opening 12. The rim of the second opening 12' has a flange 13 radially extending to the center of the second opening 12', so that the radius of the second opening 12' is smaller than the radius of the first opening 12.

According to the preferred form shown, the movable body 2 is rotatably received in the compartment 11 of the casing 1 about the axis X. The movable body 2 is rotatable relative to the casing 1 between a first position and a second position. The movable body 2 in the most preferred form shown is a hollow, cylindrical member and includes a closed end 27 and an open end 28 spaced from the closed end 27 along the axis X. An insertion space 21 is defined between the closed end 27 and the open end 28. The insertion space 21 has an insertion hole 22 in the open end 28, and the closed end 27 has a through-hole 23. The through-hole 23 of the movable body 2 is eccentric to a central axis of the insertion hole 22, that is, the axis X in the preferred form shown. A spacing from the axis X to the center of the through-hole 23 in a radial direction perpendicular to the axis X is larger than a radius of the through-hole 23. Furthermore, the movable body 2 includes a lateral opening 24 formed in a peripheral wall of the movable body 2 extending between the closed end 27 and the open end 28 along the axis X and in communication with the insertion space 21. The lateral opening 24 is aligned with the lateral opening 14 of the casing 1 in the first position and preferably to be larger than the lateral opening 14. The movable body 2 further includes a restraining portion 26 formed on a side of the lateral opening 24. Rotation of the movable body 2 along the radial direction of the axis X is stopped when the restraining portion 26 comes in contact with two sides of the lateral opening 14 of the casing 1. The lateral opening 14 further includes a positioning groove 15 to engage with the restraining portion 26 so that angular movement of the movable body 2 is limited about the axis X relative to the casing 1. Moreover, a pin and a peripheral groove can be used to provide a similar function to limit the movable body 2 to only be able to rotate within a specific position relative to the casing 1. The movable body 2 further includes plural radial positioning holes extending through the peripheral wall of the movable body 2.

According to the preferred form shown, the key receiving seat 3 is movable along the axis X between a first position received in the insertion space 21 of the movable body 2 and a second position at least partially outside of the movable body 2. The key receiving seat 3 includes first and second sides 37 and 38 spaced along the axis X. Two slots 31 are defined in a periphery of the key receiving seat 3 and extend along the axis X. For each slot 31, a limiting member 25 such as a pin is extended therethrough, while the limiting member 25 also passes through one of the positioning holes of the movable body 2. Therefore, the key receiving seat 3 can only move relative to the movable body 2 along the axis X. Furthermore, alternatively, the slot 31 can be formed in the movable body 2, and the positioning holes can be formed on the key receiving seat 3 to provide the same restraining effect for limiting relative movement between the movable body 2 and the key receiving seat 3 along the axis X. A passage 32 extending from the first side 37 through the second side 38 and having an enlarged receiving section 34 is coaxial to the through-hole 23 of the movable body 2 when the movable body 2 is in the first position, with the enlarged receiving section 34 having a diameter larger than other parts of the passage 32. An end of the receiving section 34 has non-circular cross sections in the first side 37. The passage 32 is aligned with the through-hole 23 and is eccentric to a central axis of key receiving seat 3, that is, the axis X in the preferred form shown. A spacing from the axis X to the center of the passage 32 in a radial direction perpendicular to the axis X is larger than a radius of the passage 32. The key receiving seat 3 further includes a cutoff section 33 forming a step with a substantially axial plane passing through the receiving section 34 to expose an inner space of the receiving section 34 to the lateral opening 24. Preferably, the axial plane of the step passes through a central axis of the receiving section 34. Furthermore, a lateral groove 35 is formed in a peripheral wall of the receiving section 34 and in communication with the receiving section 34 and the cutoff section 33. A positioning member 36 is arranged in the inner periphery of the passage 32, while a plurality of recess holes is formed in the outer periphery of the linking rod 4. Therefore, when the linking rod 4 rotates relative to the key receiving seat 3, the linking rod 4 can be stopped in a specific position through releasable engagement between the positioning member 36 and any one of the recess holes.

According to the preferred form shown, the linking rod 4 extends through the passage 32 of the key receiving seat 3 and includes first and second ends spaced along the axis X, with the first end of the linking rod 4 having an engaging portion 42 received in the receiving section 34. The engaging portion 42 has a diameter larger than the diameter of the passage 32 except for the receiving section 34. In the most preferred form shown, the engaging portion 42 of the linking rod 4 further includes an engaging groove 43 having an attracting member 44. A knob 41 is fixed by a fastener 45 such as a pin or screw to the second end of the linking rod 4.

According to the preferred form shown, a key 5 includes an end having a bladed portion 51 insertable into the keyhole 61 of the lock 6. A coupling portion 52 is formed on the other end of the key 5. The key 5 further includes another attracting member 53 to be attracted to and to contact with the attracting member 44 of the linking rod 4, to prevent the key 5 from falling out of the engaging groove 43 and to position the key 5 in the desired location when the linking rod 4 rotates. Furthermore, the attracting members 44 and 53 can be selected from magnets respectively providing opposite poles facing each other. Alternatively, one of the attracting members 44 and 53 can be a magnet while the other one of them is a permeable material such as iron alloy.

In use, the unlocking device according to the preferred teachings of the present invention is mounted to the side of the lock 6 with the passage 32 and the through-hole 23 aligned with the keyhole 61. The unlocking device according to the preferred teachings of the present invention can be mounted to the side of the lock 6 by any suitable provisions. As an example, the casing 1 can include a fixing portion that can be screwed to the side of the lock 6. In another example, an additional fixing seat can be provided to fix the unlocking device in place. The unlocking device according to the preferred teachings of the present invention can be utilized with various locks including locks for boxes, door locks, U-shaped locks, and vehicle locks.

Figure 2:
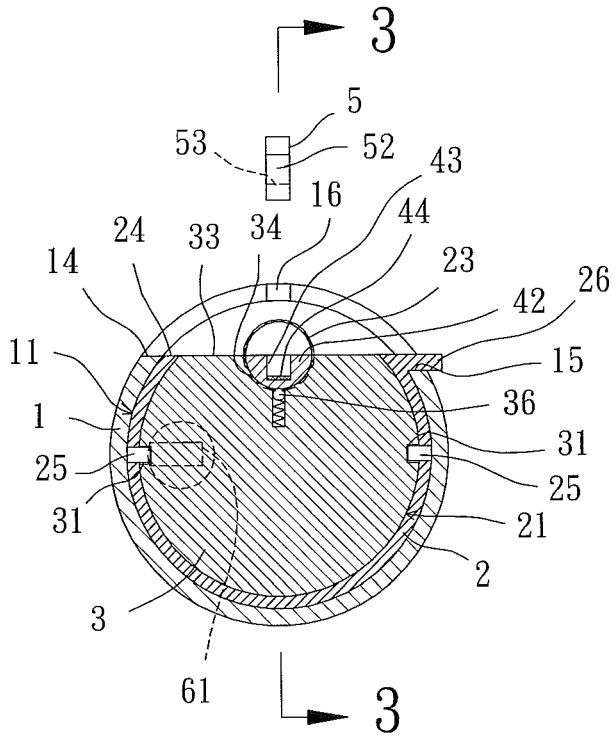
FIG. 2 shows a cross sectional view of the unlocking device of FIG. 1 with a key inserted into the unlocking device.
Figure 3:
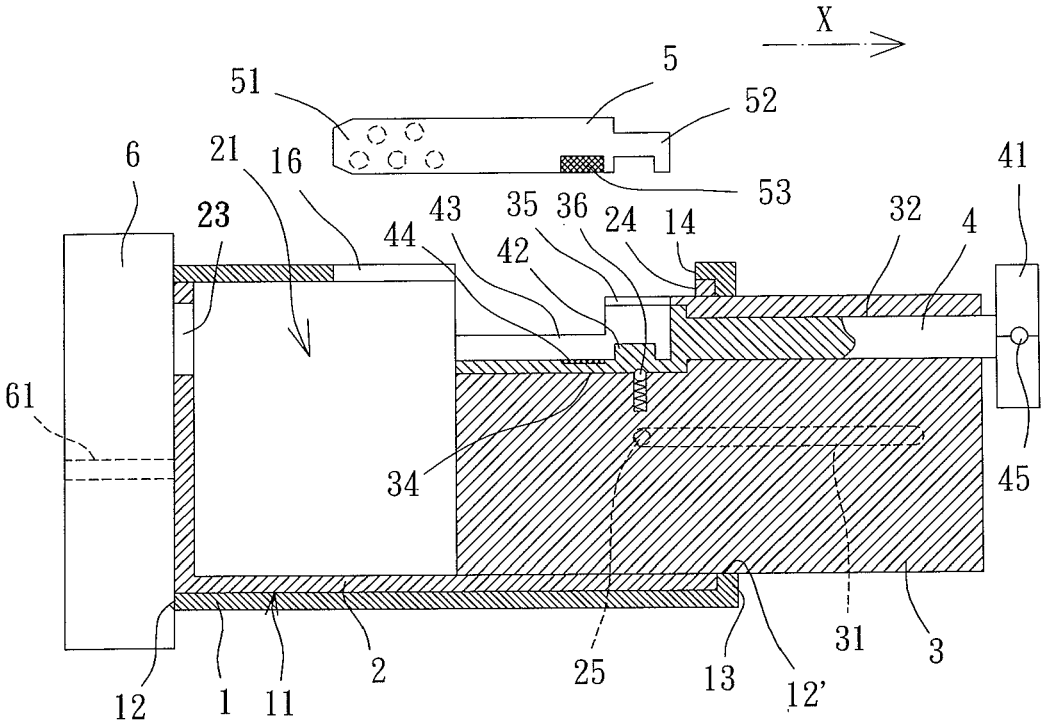
FIG. 3 shows another cross sectional view of the unlocking device of FIG. 1 along line 3-3 of FIG. 2 with a key inserted into the unlocking device.

Please refer to FIGS. 2-5. In operation, when the movable body 2 is in the first position, the lateral opening 24 is aligned with the lateral opening 14 to reveal the key receiving seat 3, which is received in the insertion space 21. It can be appreciated that the restraining portion 26 is received in the positioning groove 15. Next, the linking rod 4 and the key receiving seat 3 are jointly moved along the axis X by pulling the knob 41 away from the casing 1 until the cutoff section 33 and the engaging groove 43 are revealed. Then, the key 5 is inserted into the engaging groove 43 through the receiving groove 16, lateral opening 14, lateral opening 24, and cutoff section 33. Besides, the coupling portion 52 of the key 5 contacts with the engaging portion 42 of the linking rod 4, while the two attracting members 44 and 53 attract each other. Since the movably body 2 is in the first position relative to the casing 1, the keyhole 61 of the lock 6 is blocked by the closed end 27 of the movable body 2, and the through-hole 23 of the movable body 2 is not aligned with the keyhole 61 (FIGS. 1-3).

Next, the restraining portion 26 is pushed to rotate the movable body 2 a certain orientation relative to the casing up to the second position, such that the through-hole 23 of the movable body 2, the keyhole 61, and the passage 32 face and align with one another. Besides, when the movable body 2 is in the second position, the lateral opening 14 and the key receiving seat 3 are shielded.

Figure 4:
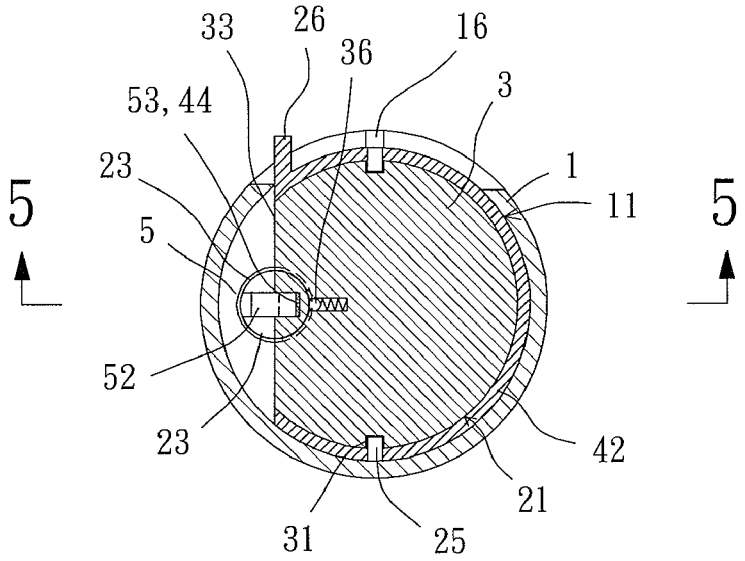
FIG. 4 is a cross sectional view similar to FIG. 2, illustrating a locking or unlocking operation.
Figure 5:
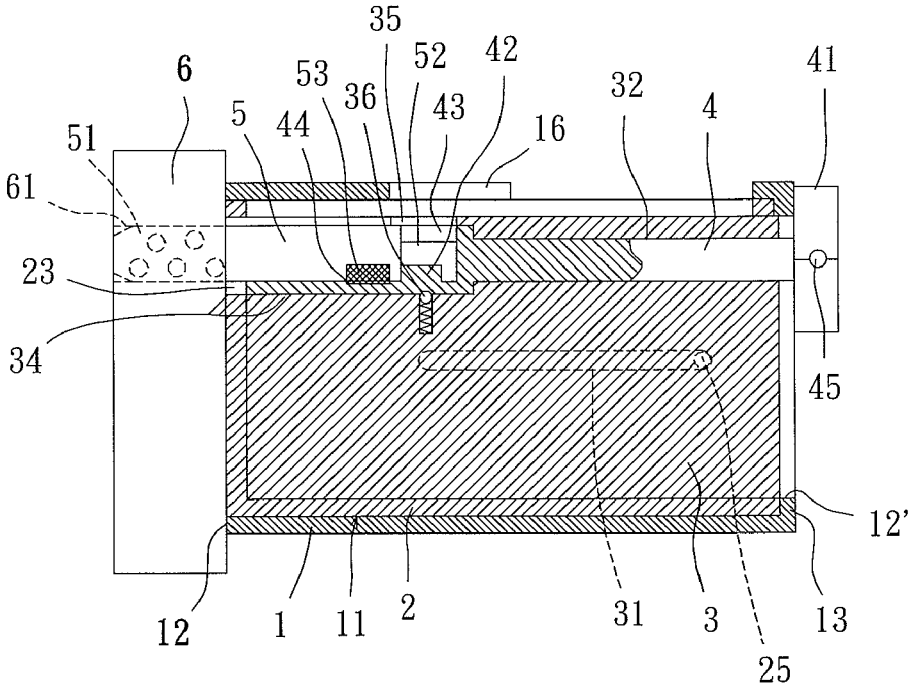
FIG. 5 is a cross sectional view along line 5-5 of FIG. 4 and similar to FIG. 3, illustrating a locking or unlocking operation.

Then, the linking rod 4 is pushed at the knob 41 to move toward the casing 1 along the axis X, so that the bladed portion 51 of the key 5 moves through the through-hole 23 of the movable body 2 into the keyhole 61 of the lock 6. Finally, the knob 41 of the linking rod 4 is rotated for a locking or unlocking operation (FIGS. 4-5). Additionally, the present unlocking device can be operated in a reverse order of the above steps for release of the key 5 therefrom.

According to the above, the unlocking device according to the preferred teachings of the present invention can guide the key 5 into the keyhole 61 of the lock 6 as well as conceal the keyhole 61 to prevent direct access to the keyhole 61.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. An unlocking device comprising:

a casing adapted to be mounted to a side of a lock having a keyhole, with the casing including a compartment extending along an axis and having first and second openings spaced along the axis, with the keyhole located in an extent of the first opening, with the casing further including a lateral opening formed in a peripheral wall of the casing and in communication with the compartment;

a movable body rotatably received in the compartment of the casing about the axis, with the movable body including a closed end and an open end spaced from the closed end along the axis, with an insertion space defined between the closed end and the open end, with the insertion space having an insertion hole in the open end, with the closed end having a through-hole, with the movable body further including a lateral opening formed in a peripheral wall of the movable body extending between the closed end and the open end along the axis and in communication with the insertion space, with the movable body including a restraining portion formed on a side of the lateral opening of the movable body to limit angular movement of the movable body about the axis relative to the casing;

a key receiving seat received in the insertion space of the movable body, with the movable body rotatable relative to the key receiving seat between a first position and a second position, with the key receiving seat including a passage extending from a first side through a second side along the axis and having an enlarged receiving section, with the keyhole of the lock being blocked by the closed end of the movable body when the movable body is in the first position, with the through-hole of the movable body, the passage of the key receiving seat, and the keyhole of the lock aligned with and facing one another when the movable body is in the second position; and a linking rod extending through the passage of the key receiving seat, with the linking rod including first and second end spaced along the axis, with the first end of the linking rod having an engaging portion, with the second end of the linking rod being manually rotatable, with the engaging portion being used for engaging with a key, so that the key and the linking rod are able to jointly move along the axis and jointly rotate about the axis.

2. The unlocking device as claimed in claim 1, with the through-hole of the movable body being eccentric to a central axis of the insertion hole.

3. The unlocking device as claimed in claim 2, with a spacing from the axis to the center of the through-hole in a radial direction perpendicular to the axis being larger than a radius of the through-hole.

4. The unlocking device as claimed in claim 1, wherein the engaging portion is received in the receiving section, with a diameter of the engaging portion larger than the diameter of the passage except for the receiving section of the key receiving seat.

5. The unlocking device as claimed in claim 1, with the key receiving seat further including a lateral groove formed in a peripheral wall of the receiving section and in communication with the receiving section, with the engaging portion of the linking rod including an engaging groove for receiving the key.

6. The unlocking device as claimed in claim 5, with the linking rod including an attracting member to be used for being attracted and contacting with another attracting member of the key.

7. The unlocking device as claimed in claim 1, with a knob fixed to the first end of the linking rod.

8. An unlocking device comprising:

a casing adapted to be mounted to a side of a lock having a keyhole, with the casing including a compartment extending along an axis and having first and second openings spaced along the axis, with the keyhole located in an extent of the first opening, with the casing further including a lateral opening formed in a peripheral wall of the casing and in communication with the compartment;

a movable body rotatably received in the compartment of the casing about the axis, with the movable body including a closed end and an open end spaced from the closed end along the axis, with an insertion space defined between the closed end and the open end, with the insertion space having an insertion hole in the open end, with the closed end having a through-hole, with the movable body further including a lateral opening formed in a peripheral wall of the movable body extending between the closed end and the open end along the axis and in communication with the insertion space;

a key receiving seat received in the insertion space of the movable body, with the movable body rotatable relative to the key receiving seat between a first position and a second position, with the key receiving seat including a passage extending from a first side through a second side along the axis and having an enlarged receiving section, with the keyhole of the lock being blocked by the closed end of the movable body when the movable body is in the first position, with the through-hole of the movable body, the passage of the key receiving seat, and the keyhole of the lock aligned with and facing one another when the movable body is in the second position; and a linking rod extending through the passage of the key receiving seat, with the linking rod including first and second end spaced along the axis, with the first end of the linking rod having an engaging portion, with the second end of the linking rod being manually rotatable, with the engaging portion being used for engaging with a key, so that the key and the linking rod are able to jointly move along the axis and jointly rotate about the axis, wherein the engaging portion is received in the receiving section, with a diameter of the engaging portion larger than the diameter of the passage except for the receiving section of the key receiving seat, with the passage being eccentric to a central axis of the key receiving seat.

9. The unlocking device as claimed in claim 8, with a spacing from the axis to the center of the passage in a radial direction perpendicular to the axis being larger than a radius of the passage.

10. The unlocking device as claimed in claim 8, with the key receiving seat movable along the axis between a first position received in the insertion space of the movable body and a second position at least partially outside of the movable body.

11. The unlocking device as claimed in claim 10, with the passage being coaxial to the through-hole of the movable body when the lateral opening of the movable body is aligned with the lateral opening of the casing in the first position.

12. An unlocking device comprising:

a casing adapted to be mounted to a side of a lock having a keyhole, with the casing including a compartment extending along an axis and having first and second openings spaced along the axis, with the keyhole located in an extent of the first opening, with the casing further including a lateral opening formed in a peripheral wall of the casing and in communication with the compartment;

a movable body rotatably received in the compartment of the casing about the axis, with the movable body including a closed end and an open end spaced from the closed end along the axis, with an insertion space defined between the closed end and the open end, with the insertion space having an insertion hole in the open end, with the closed end having a through-hole, with the movable body further including a lateral opening formed in a peripheral wall of the movable body extending between the closed end and the open end along the axis and in communication with the insertion space;

a key receiving seat received in the insertion space of the movable body, with the movable body rotatable relative to the key receiving seat between a first position and a second position, with the key receiving seat including a passage extending from a first side through a second side along the axis and having an enlarged receiving section, with the keyhole of the lock being blocked by the closed end of the movable body when the movable body is in the first position, with the through-hole of the movable body, the passage of the key receiving seat, and the keyhole of the lock aligned with and facing one another when the movable body is in the second position; and a linking rod extending through the passage of the key receiving seat, with the linking rod including first and second end spaced along the axis, with the first end of the linking rod having an engaging portion, with the second end of the linking rod being manually rotatable, with the engaging portion being used for engaging with a key, so that the key and the linking rod are able to jointly move along the axis and jointly rotate about the axis, with the key receiving seat further including a lateral groove formed in a peripheral wall of the receiving section and in communication with the receiving section, with the engaging portion of the linking rod including an engaging groove for receiving the key, with the linking rod including an attracting member to be used for being attracted and contacting with another attracting member of the key, with one of the attracting members being a magnet while another one of the attracting members is a permeable material.

* * * * *